US011293598B1

(12) United States Patent
Wang

(10) Patent No.: US 11,293,598 B1
(45) Date of Patent: Apr. 5, 2022

(54) DUAL-RESISTOR SHATTER-RESISTANT BULB

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO, , LTD., Dongguan (CN)

( * ) Notice: Subject to any disclaimer, the term of this patent is extended or adjusted under 35 U.S.C. 154(b) by 0 days.

(21) Appl. No.: 17/183,363

(22) Filed: Feb. 24, 2021

(30) Foreign Application Priority Data

Feb. 1, 2021 (CN) ..... 202120281056.4

(51) Int. Cl.

| | |
|---|---|
| ***F21K 9/232*** | (2016.01) |
| ***F21V 17/10*** | (2006.01) |
| ***F21K 9/235*** | (2016.01) |
| ***F21Y 115/10*** | (2016.01) |

(52) U.S. Cl.
CPC ..... *F21K 9/232* (2016.08); *F21K 9/235* (2016.08); *F21V 17/101* (2013.01); *F21Y 2115/10* (2016.08)

(58) Field of Classification Search
CPC ..... F21K 9/235
See application file for complete search history.

(56) References Cited

U.S. PATENT DOCUMENTS

| | | | | |
|---|---|---|---|---|
| 10,234,079 | B1 * | 3/2019 | Spehalski | F21K 9/235 |
| 10,718,471 | B1 * | 7/2020 | Wu | F21K 9/66 |
| 2010/0253221 | A1 * | 10/2010 | Chiang | F21K 9/232 315/32 |
| 2015/0252954 | A1 * | 9/2015 | Hu | F21K 9/23 362/382 |
| 2016/0369949 | A1 * | 12/2016 | Wu | F21K 9/23 |
| 2019/0203921 | A1 * | 7/2019 | He | F21V 7/22 |
| 2019/0257478 | A1 * | 8/2019 | Wang | F21V 23/06 |
| 2019/0323695 | A1 * | 10/2019 | Wu | F21V 23/003 |

* cited by examiner

*Primary Examiner* — Jong-Suk (James) Lee
*Assistant Examiner* — Eric T Eide

(57) ABSTRACT

The present invention relates to the technical field of bulbs, and discloses a dual-resistor shatter-resistant bulb. The shatter-resistant bulb includes a lamp holder and a bulb shell, and further includes a core column, a fixing base and a light-emitting component. The dual-resistor shatter-resistant bulb has the following advantages. First, a hollow structure of the fixing base helps save costs. Second, the core column and the fixing base are formed by injection molding, which can reduce the assembly processes, and prevent the bulb from breaking due to the falling core column, thus improving the falling resistance and prolonging the service life.

6 Claims, 3 Drawing Sheets

DUAL-RESISTOR SHATTER-RESISTANT BULB

TECHNICAL FIELD

The present invention relates to the technical field of bulbs, in particular to a dual-resistor shatter-resistant bulb.

BACKGROUND

Bulbs are the main lamps used for lighting. With the development of technology, a variety of bulbs have become common from conventional tungsten bulbs to the current LED chip bulbs and LED strip bulbs.

A glass column is usually arranged in the bulb shell of an existing bulb, and an LED light bar or a tungsten wire is connected based on the glass column, so that the light emitted by the bulb can be uniform as much as possible. However, the glass column is easy to break when the bulb falls unexpectedly, making the bulb less resistant to falling. Therefore, the inventor made a new invention.

SUMMARY

The purpose of the present invention is to provide a dual-resistor shatter-resistant bulb with good falling resistance to address defects in the prior art.

In order to achieve the purpose, the present invention provides a dual-resistor shatter-resistant bulb, comprising a lamp holder and a bulb shell, and further comprising a core column, a fixing base and a light-emitting component, wherein the light-emitting component comprises a first resistor, a first LED light bar, a transverse wire, a second LED light bar and a second resistor which are electrically connected in sequence; the fixing base is provided with a hollow space for accommodating the first resistor and the second resistor, the core column and a fixed column are formed by plastic molding, the transverse wire embedded into the core column is integrated with the first resistor and the second resistor embedded into the fixing base; the first resistor is electrically connected with one electrode of the lamp holder, and the second resistor is electrically connected with the other electrode of the lamp holder, and the bulb shell is formed by plastic molding.

For resistors of the present invention, the first resistor comprises a resistor a, with one end of the resistor a connected with a first wire and the other end of the resistor a connected with a second wire, and the second resistor comprises a resistor b, with one end of the resistor b connected with a third wire and the other end of the resistor a connected with a fourth wire.

Preferably, both ends of the first LED light bar are electrically connected to one end of the second wire and the transverse wire respectively, and both ends of the second LED light bar are electrically connected to the other end of the third wire and the transverse wire respectively.

Further, glue is applied between the lamp holder and the outer side of the mouth of the bulb shell, the lamp holder is threaded with the bulb shell and an air gap is reserved.

Further, two extended bosses are arranged in the hollow space, and the first resistor and the second resistor are embedded in the extended bosses.

Further, the bulb shell is transparent or translucent, and both the core column and the fixing base are resistant to a high temperature of 80° C.

Further, a convex ring matched with the mouth of the bulb shell is arranged at the mouth of the fixing base, a plurality of convex points are uniformly distributed on the side of the convex ring, and the fixing base is tightly matched with the mouth of the bulb shell through the convex points.

Preferably, a water gap is reserved at the bottom electrode of the lamp holder.

Advantageous effects: Compared with the prior art, the dual-resistor shatter-resistant bulb provided by the present invention comprises a lamp holder and a bulb shell, and further comprises a core column, a fixing base and a light-emitting component, wherein the core column and the fixing base are formed by plastic molding, and the transverse wire embedded into the core column is integrated with the first resistor and the second resistor embedded into the fixing base; the first resistor is electrically connected with one electrode of the lamp holder, and the second resistor is electrically connected with the other electrode of the lamp holder. The dual-resistor shatter-resistant bulb has the following advantages: 1. a hollow structure of the fixing base helps save costs; and 2. the core column and the fixing base are formed by injection molding, which can reduce the assembly processes, and prevent the bulb from breaking due to the falling core column, thus improving the falling resistance and prolonging the service life.

Lamp holder—1, bulb shell—2, core column—3, fixing base—4, extended bosses—41, convex ring—42, convex point—43, light—emitting component—5, first resistor—51, resistor a—511, first wire—512, second wire—513, first LED light bar—52, transverse wire—53, second LED light bar—54, second resistor—55, resistor b—551, third wire—552, fourth wire—553.

DESCRIPTION OF THE INVENTION

Figure 1:
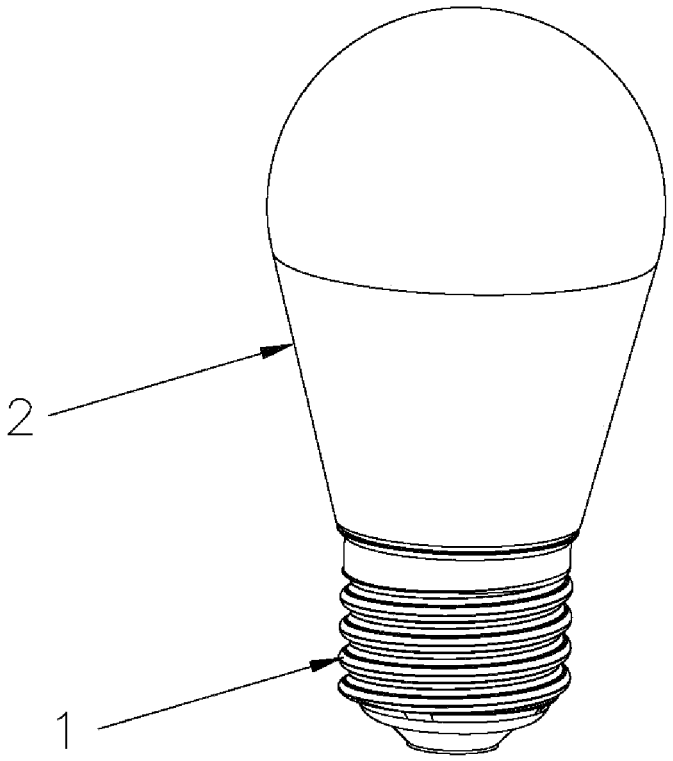
FIG. 1 is a 3D diagram of the present invention.
Figure 2:
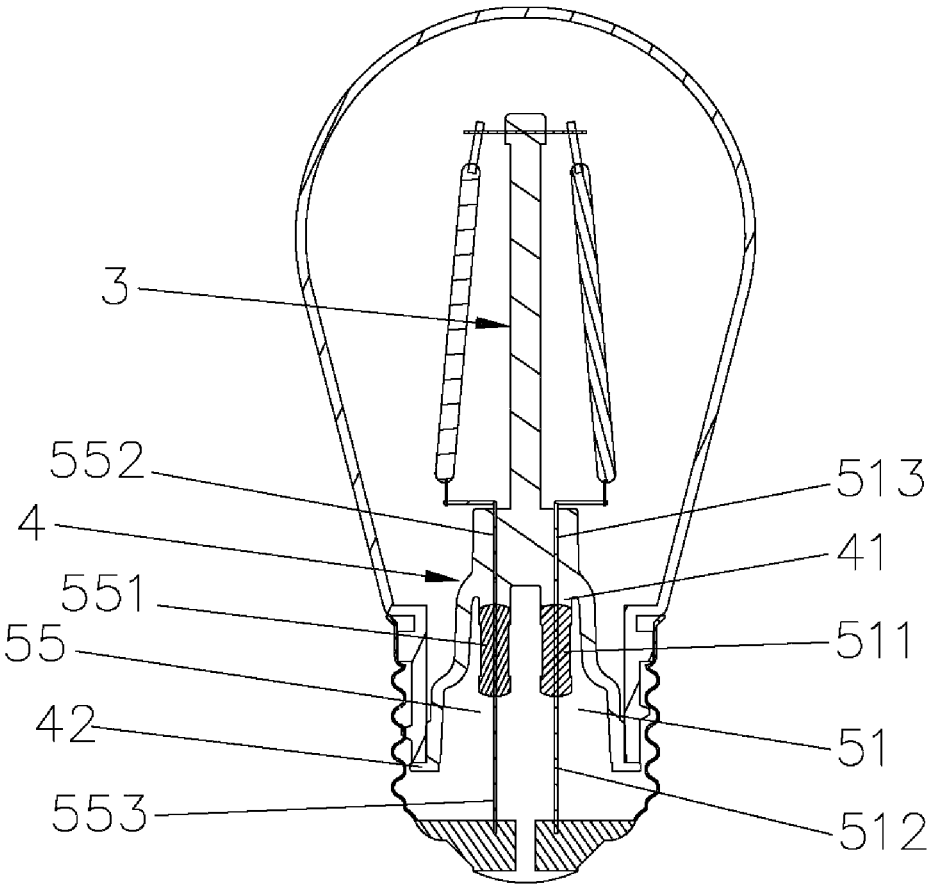
FIG. 2 is a section view of the present invention.
Figure 3:
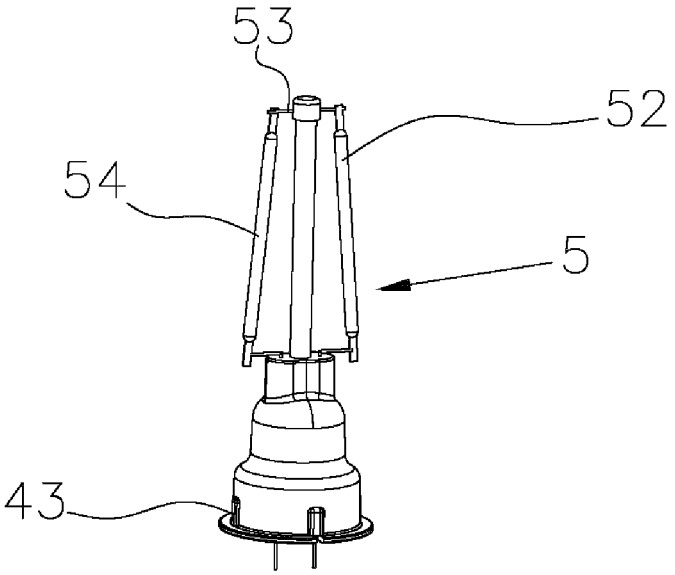
FIG. 3 is a schematic diagram of the inner structure of the present invention.

The present invention will be described in detail with reference to FIG. 1 to 3.

The present invention provides a dual-resistor shatter-resistant bulb, including a lamp holder 1 and a bulb shell 2, and further comprising a core column 3, a fixing base 4 and a light-emitting component 5, wherein the light-emitting component 5 comprises a first resistor 51, a first LED light bar 52, a transverse wire 53, a second LED light bar 54 and a second resistor 55 which are electrically connected in sequence; the fixing base is provided with a hollow space for accommodating the first resistor and the second resistor, the core column and a fixed column are formed by plastic molding, the transverse wire embedded into the core column is integrated with the first resistor and the second resistor embedded into the fixing base; the first resistor is electrically connected with one electrode of the lamp holder, and the second resistor is electrically connected with the other electrode of the lamp holder, and the bulb shell is formed by plastic molding. The fixing base and the core column of the bulb are formed by plastic molding, so that the bulb can be prevented from breaking due to falling core column. On the other hand, the bulb uses dual resistors to prevent high temperature build-up due to the plastic molding, the dual resistors can disperse heat when using the bulb to avoid heat concentration and prevent temperature rise as much as possible. In this way, undesirable phenomena of plastics due to high temperature build-up can be avoided when the core column and the fixing base formed by plastic molding are used. The actual test showed that the core column did not break in a drop test at a height of 2 m.

For resistors of the present invention, the first resistor 51 comprises a resistor a511, with one end of the resistor a connected with a first wire 512 and the other end of the resistor a connected with a second wire 513, and the second resistor 55 comprises a resistor b551, with one end of the resistor b connected with a third wire 552 and the other end of the resistor a connected with a fourth wire 553. It is better to reserve a certain length for the second wire and the third wire, which is beneficial for the bending when connecting the light bars, so that the light emitting angle of the light bars is inclined and the luminous efficiency is maximized.

Specifically, both ends of the first LED light bar 52 are electrically connected to one end of the second wire 513 and the transverse wire 53 respectively, and both ends of the second LED light bar are electrically connected to the other end of the third wire 552 and the transverse wire 53 respectively. The first LED light bar and the second LED light bar are arranged obliquely in a symmetrical way, so that light from the light bars can be inclined to the bulb shell end of the bulb, which improves the utilization of luminous efficiency.

In the technical solution, glue is applied between the lamp holder and the outer side of the mouth of the bulb shell to strengthen the connection and fixation between the lamp holder 1 and the bulb shell 2. In order to enable water in the lamp holder caused by the use environment to be discharged, the lamp holder is threaded with the bulb shell and an air gap is reserved. When the lamp is in use, heat from the lamp will evaporate water in the lamp holder, thus keeping the interior of the lamp holder dry and reducing water accumulation.

In order to optimize the positions of the first resistor and the second resistor, two extended bosses 41 are arranged in the hollow space, and the first resistor 51 and the second resistor 55 are embedded in the extended bosses 41. That is, both the first resistor and the second resistor are arranged on the extended bosses 41, in this way, the extended bosses 41 can improve the strength of the fixing base 4, and can also prevent water accumulated in the hollow space from affecting the performance of the resistors.

Based on different needs, the bulb shell is transparent or translucent, and both the core column and the fixing base are resistant to a high temperature of 80° C. The high temperature resistance allows the bulb to be used in most high temperature environments, while maintaining sufficient strength for the integrated core column and fixing base.

In the technical solution, a convex ring 42 matched with the mouth of the bulb shell is arranged at the mouth of the fixing base 4, a plurality of convex points 43 are uniformly distributed on the side of the convex ring 42, and the fixing base is tightly matched with the mouth of the bulb shell through the convex points 43. A plurality of convex points allow the bulb shell to be tightly matched, the convex ring 42 can prevent rainwater from entering the bulb shell, and rainwater can also escape between the convex points 42. A water gap is reserved at the bottom electrode of the lamp holder to increase the evaporation or discharge of water in the lamp holder.

The above contents are only preferred embodiments of the present invention. For those of ordinary skill in the art, there will be changes in specific embodiments and application scope according to the idea of the present invention, the contents of the specification should not be construed as a limitation to the present invention.

What is claimed is:

1. A dual-resistor shatter-resistant bulb, comprising a lamp holder and a bulb shell, and characterized by further comprising a core column, a fixing base and a light-emitting component, wherein the light-emitting component comprises a first resistor, a first LED light bar, a transverse wire, a second LED light bar and a second resistor which are electrically connected in sequence; the fixing base is provided with a hollow space for accommodating the first resistor and the second resistor, the core column and a fixed column are formed by plastic molding, the transverse wire embedded into the core column is integrated with the first resistor and the second resistor embedded into the fixing base; the first resistor is electrically connected with one electrode of the lamp holder, and the second resistor is electrically connected with the other electrode of the lamp holder, and the bulb shell is formed by plastic molding;

wherein a resistance of the first resistor is same as a resistance of the second resistor; two extended bosses are arranged in the hollow space, and the first resistor and the second resistor are embedded in the extended bosses;

wherein a convex ring matched with the mouth of the bulb shell is arranged at the mouth of the fixing base, a plurality of convex points are uniformly distributed on the side of the convex ring, and the fixing base is tightly matched with the mouth of the bulb shell through the convex points.

2. The dual-resistor shatter-resistant bulb according to claim 1, wherein the first resistor comprises a resistor a, with one end of the resistor a connected with a first wire and the other end of the resistor a connected with a second wire, and the second resistor comprises a resistor b, with one end of the resistor b connected with a third wire and the other end of the resistor a connected with a fourth wire.

3. The dual-resistor shatter-resistant bulb according to claim 2, wherein both ends of the first LED light bar are electrically connected to one end of the second wire and the transverse wire respectively, and both ends of the second LED light bar are electrically connected to the other end of the third wire and the transverse wire respectively.

4. The dual-resistor shatter-resistant bulb according to claim 1, wherein glue is applied between the lamp holder and the outer side of the mouth of the bulb shell, the lamp holder is threaded with the bulb shell and an air gap is reserved.

5. The dual-resistor shatter-resistant bulb according to claim 1, wherein the bulb shell is transparent or translucent, and both the core column and the fixing base are resistant to a high temperature of 80° C.

6. The dual-resistor shatter-resistant bulb according to claim 1, wherein a water gap is reserved at the bottom electrode of the lamp holder.

* * * * *